US006715328B2

(12) United States Patent
Hartnagel

(10) Patent No.: US 6,715,328 B2
(45) Date of Patent: Apr. 6, 2004

(54) BRACING DEVICE FOR A BENDING MACHINE

(75) Inventor: Dieter Hartnagel, Reutlingen (DE)

(73) Assignee: Trumpf Pulzer GmbH +Co. KG, Reutlingen (DE)

( * ) Notice: Subject to any disclaimer, the term of this patent is extended or adjusted under 35 U.S.C. 154(b) by 0 days.

(21) Appl. No.: 10/320,297

(22) Filed: Dec. 16, 2002

(65) Prior Publication Data

US 2003/0140675 A1 Jul. 31, 2003

Related U.S. Application Data

(63) Continuation-in-part of application No. 09/787,728, filed on May 29, 2001, now abandoned.

(30) Foreign Application Priority Data

Sep. 25, 1998 (DE) ..... 198 43 867
Apr. 29, 1999 (DE) ..... 199 19 508

(51) Int. Cl.[7] ..... B21D 7/024
(52) U.S. Cl. ..... 72/154; 72/158
(58) Field of Search ..... 72/154, 157, 158

(56) References Cited

U.S. PATENT DOCUMENTS 4,126,030 A * 11/1978 Zollweg et al. ..... 72/154
4,130,004 A * 12/1978 Eaton ..... 72/151
4,495,788 A * 1/1985 Traub ..... 72/157
5,042,279 A * 8/1991 Togoshi ..... 72/29.2
5,495,740 A * 3/1996 Schwarze ..... 72/149

FOREIGN PATENT DOCUMENTS

EP 0 538 207 * 4/1993
GB 2 187 666 * 9/1987

* cited by examiner

*Primary Examiner*—Lowell A. Larson
(74) *Attorney, Agent, or Firm*—Michael J. Striker

(57) ABSTRACT

A bracing device for a bending machine, in particular for a tube bending machine, in the form of a slide rail moved linearly in slaved fashion in the bending operation and having a plurality of slide rail extensions for different bending radii, which are mounted on the slide rail (12) via lockable and unlockable adapters.

4 Claims, 5 Drawing Sheets

BRACING DEVICE FOR A BENDING MACHINE

CROSS-REFERENCE TO A RELATED APPLICATION

This application is a continuation-in-part of application Ser. No. 09/787,728 filed on May 29, 2001, now abandoned.

BACKGROUND OF THE INVENTION

The invention relates to a bracing device for a bending machine, in particular for a tube bending machine, in form of a slide rail, moved linearly in slaved fashion in the bending operation, with a plurality of slide rail extensions for different bending radii.

Since in bending machines with a bracing device of the type defined at the outset, all the slide rail extensions move simultaneously, these bending machines have the disadvantage that when relatively large radii are being bent, the slide rail extension for a smaller radius can collide with tool parts, such as a clamping jaw, for the small radius if the radii differ accordingly from one another. Until now, this problem has been solved by using bracing rollers instead of slide rails. For demanding bending tasks, such as bending of very thin-walled tubes or very soft tubes or bending very small radii, however, bracing rollers are no longer suitable. Then the use of slide rails is absolutely required.

U.S. Pat. No. 5,042,979 discloses a bending machine with several bend dyes have different diameters and movable in a horizontal direction and in a vertical direction so as to bend a tube at different curvatures. The pressure dyes are not movable axially to the tube or parallel to the axis of the tube, and also the pressure dyes are not removably attached via a adaptors. Also, the problem of a collision of the pressure dyes with clamping jaws is not mentioned in this patent.

U.S. Pat. No. 4,130,004 discloses a tube bending machine with only one pressure dye which does not show different slide rail extensions, and therefore the problem of collision between slide rail extensions and clamping jaw or the like does not occur in this bending machine. The removable attachment of the pressure dye to the slide in this machine is not used to avoid collision between the pressure dye and clamping jaws, since at the engine of such collision does not exist.

SUMMARY OF THE INVENTION

The object of the invention is to improve a bracing device for a bending machine of the type defined at the outset in such a way that the risk of collision between slide rail extensions and tool parts is avoided.

The invention attains this stated object with a bracing device of the type defined at the outset, in that the slide rail extensions are mounted on the slide rail via lockable and unlockable adapters and the locking and unlocking of the adaptors is programmable via an MC controller. In this way, when relatively large radii are being bent, the slide rail extensions and in particular those for the small radii can preferably be decoupled from the common drive of the slide rail extensions, thus averting collision of the slide rail extensions, and especially those for the small radii, with clamping jaws or other tool parts.

With a view to comfortable machine operation, the adapters can be programmable via an NC controller or can be locked and unlocked.

To make it possible for bending machines without an adapter according to the invention to be retrofitted with an adapter, the slide rail extensions and the adapter can form a retrofitting unit.

To enable to plurality of slide rail extensions to be aligned with the height of the plurality of bending tools, the plurality of slide rail extensions and the adapter can be separately adjustable in height.

The invention also relates to a bending machine, in particular a tube bending machine, having a clamping device for a workpiece, in particular a tube to be bent, a bending head provided with a plurality of bending tools that have different radii, and a pivot arm that has a plurality of clamping jaws that can be moved horizontally and/or vertically to the longitudinal axis of the workpiece and that cooperate with the bending tools, characterized in that it has a bracing device according to the invention.

One exemplary embodiment of a bending machine embodied according to the invention will be described in further detail below in conjunction with the accompanying drawing.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
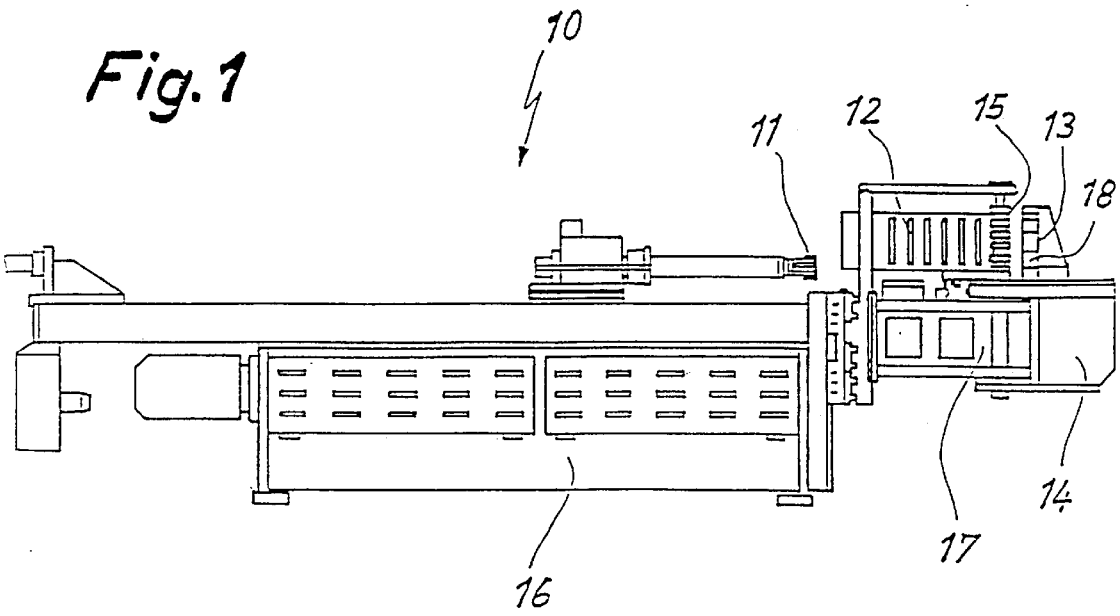
FIG. 1, a schematic view of a bending machine with a bracing device of the invention.
Figure 2:
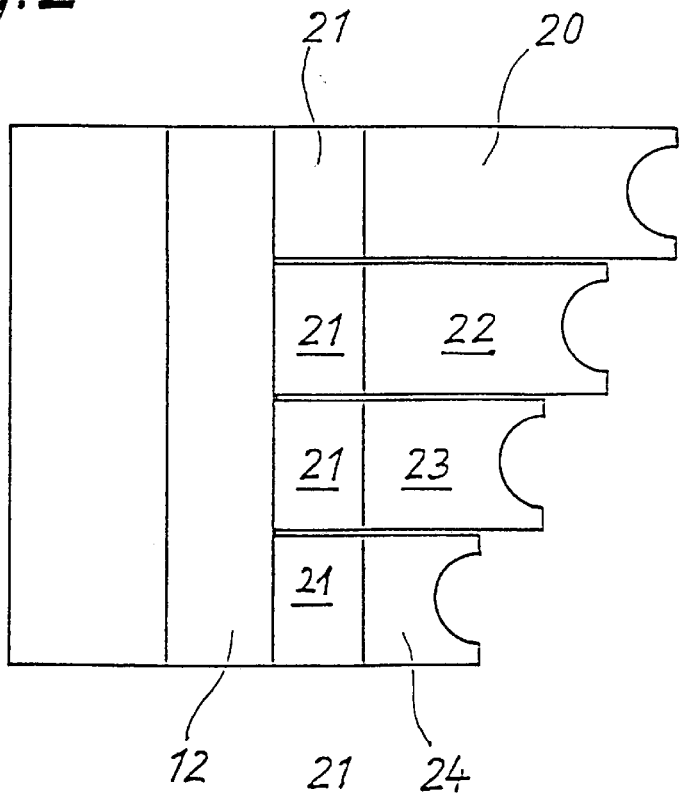
FIG. 2, a side view of the bracing device of the bending machine of FIG. 1.

FIG. 1 shows a bending machine 10 with a machine body 16 and a bending head 17. A tube to be bent, not shown in further detail, can be fastened in a clamping device 11. A slide rail 12 has the task of bracing and guiding the tube during the bending operation. On the front end of the slide rail 12, there are slide rail extensions 20, 22, 23, 24 (FIG. 2). The traveling motion of the slide rail 12 during the bending operation must be effected synchronously with the bending motion of a clamping block 13 that has clamping jaws 18 and is mounted on a pivot arm 14. In the bending operation, the tube is bent via a suitable bending tool 15.

FIG. 2 shows the slide rail 12 of FIG. 1 in an enlarged view; the four slide rail extensions 20, 22, 23, 24 are mounted lockably and unlockably on it via adapters 21. For the sake of convenient handling, the locking and unlocking can be done via the NC controller of the machine or automatically.

By means of the locking and unlocking, primarily when relatively large radii are being bent, the slide rail extension 20 for smaller bending radii can be decoupled from the slide rail. In this way, a collision between the slide rail extension 20 and the clamping jaws 18 shown in FIG. 1 can be avoided.

Figure 3:
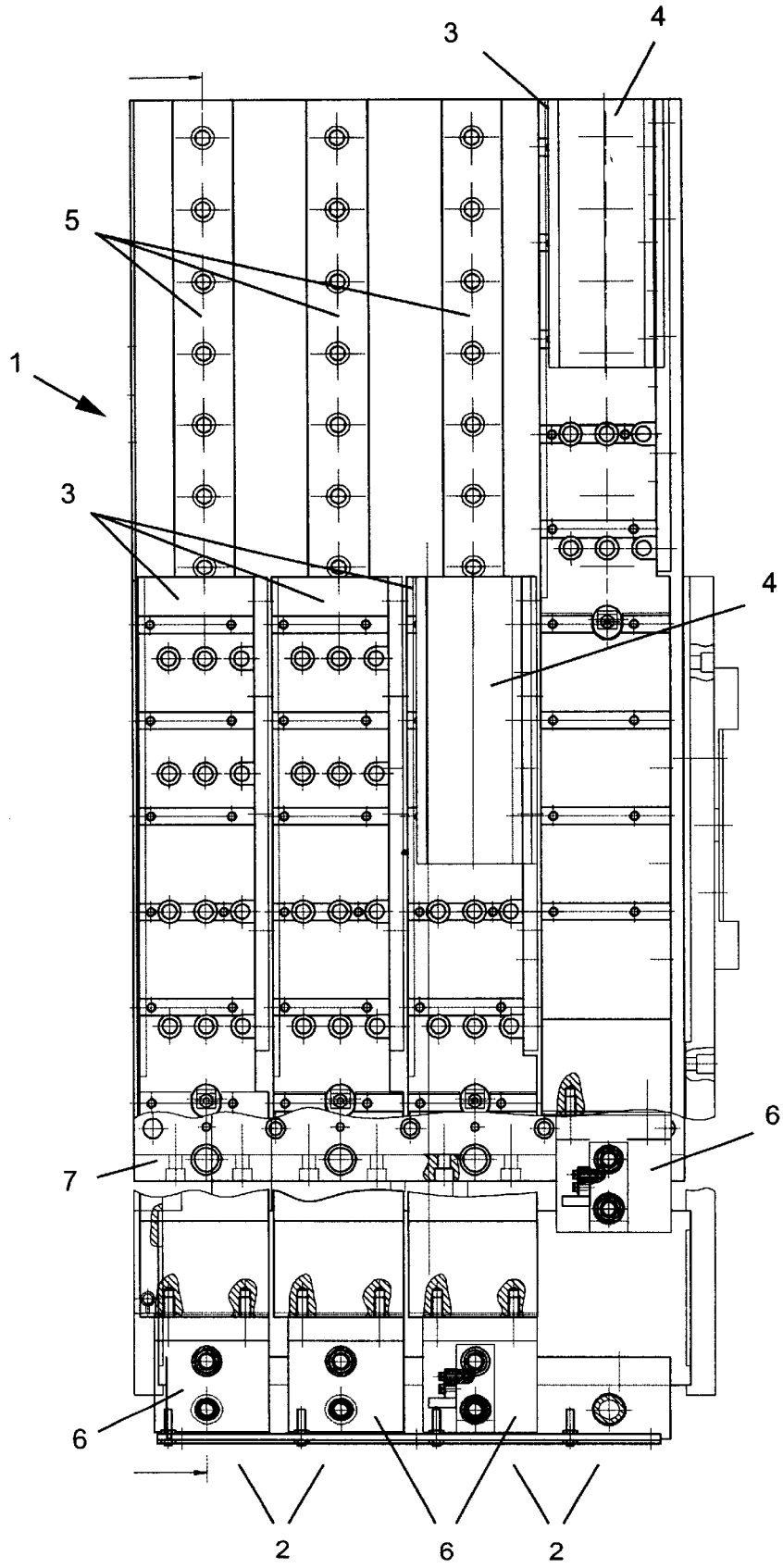
FIG. 3, a view from above of a slide rail with four levels of slide rails.

FIG. 3 shows a top view of a slide rail 1 with four levels of slide rails 2. Each level 2 has a slide 3 on which a slide rail extension 4 can be mounted. The slides are movable along a rail 5 in longitudinal direction of the tube. Each slide 3 has a locking device 6 used to connect the slides 3 with a main slide 7. The main slide 7 is moved in longitudinal direction of the tube by a cylinder 8, as shown in FIG. 4.

Numerous possibilities exist for automatically locking and unlocking two elements, as will be appreciated by one skilled in the art. For example, the adapters can be provided with pins or bolts that are insertable into grooves or holes of the slide rail. The insertion of the pins or bolts can be carried out via pneumatic cylinder or to be motor driven. Instead of a linear movement of bolts or pins, also a rotational movement of a locking element, like a key or the like, can be carried out in order to lock and unlock the adapters.

Figure 5:
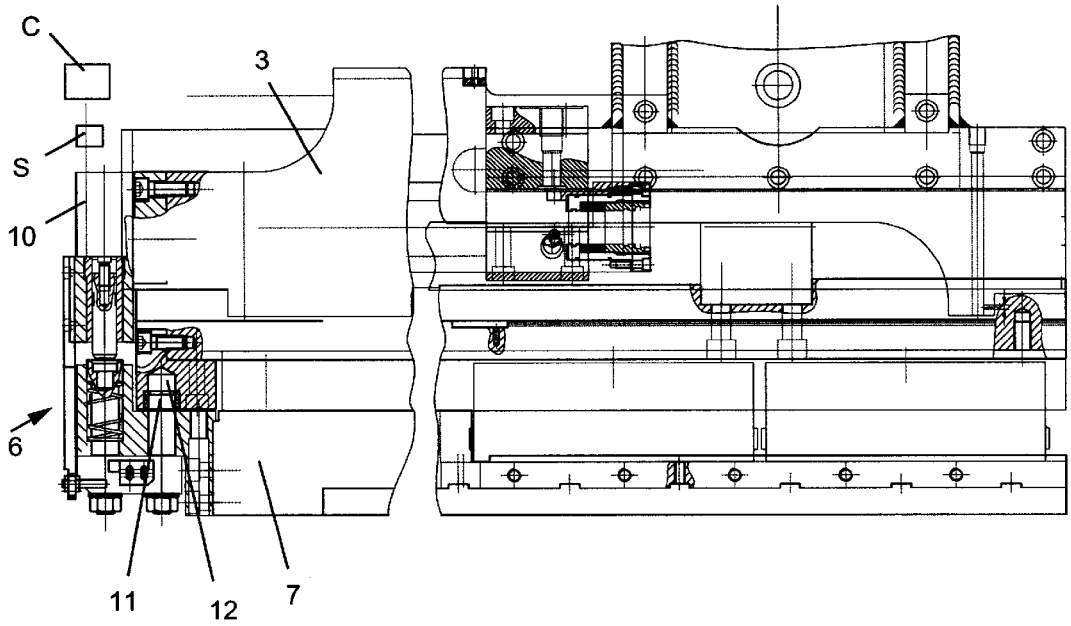
FIG. 5, one form of a locking device for the present invention.
Figure 6:
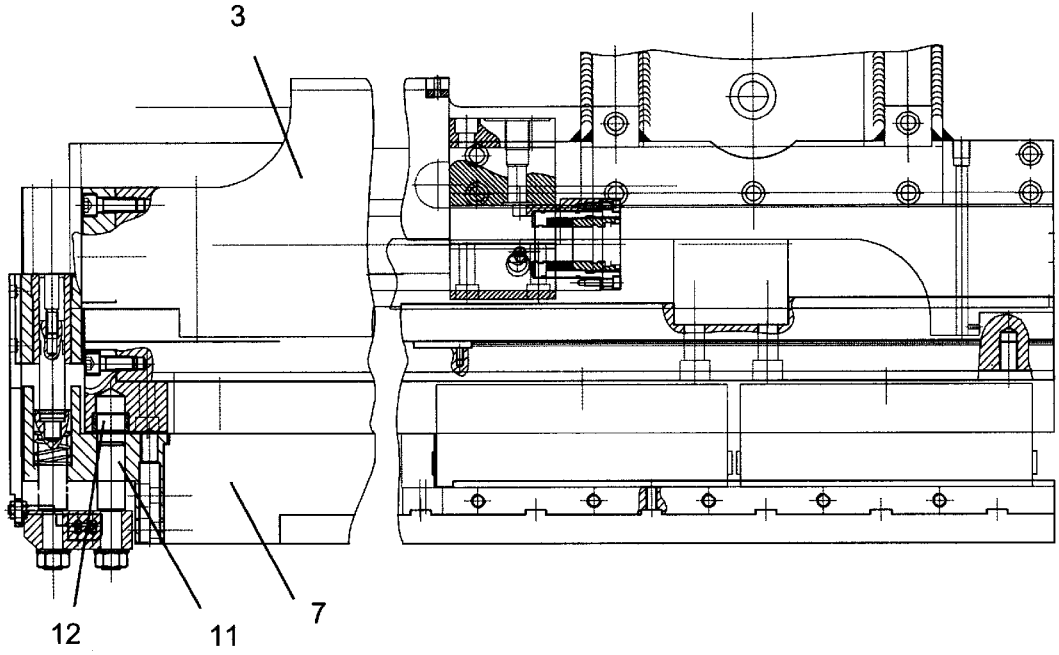
FIG. 6, the locking devices as adapters.

FIGS. 5 and 6 show how the locking devices 6 operate. The locking device 6 has a cylinder 10, which moves and removes a pin 11 from a hole 12. In FIG. 5, the pin 11 is inserted into the hole 12. The slide 3 is now locked to the main slide 7.

Figure 4:
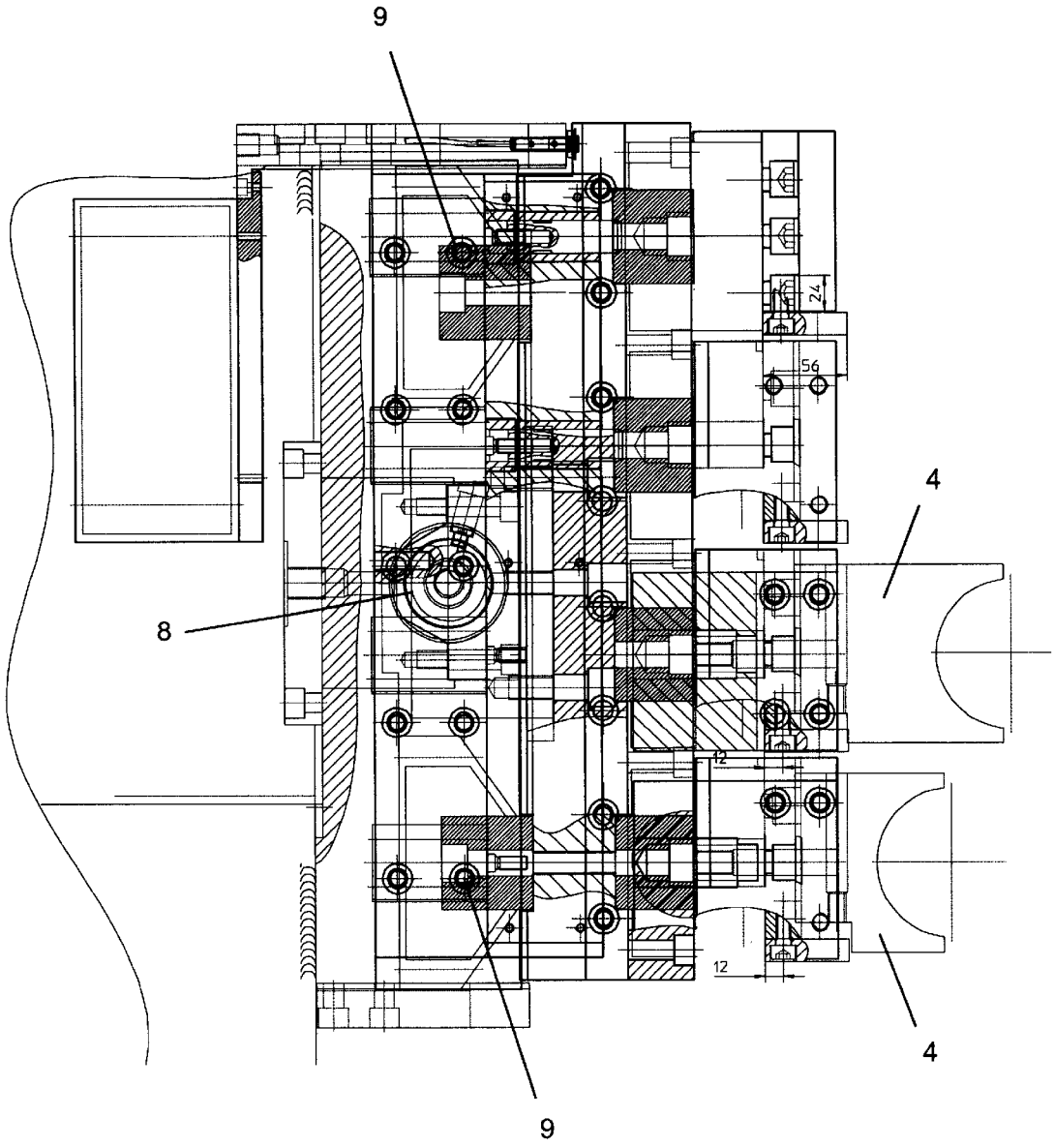
FIG. 4, a cylinder for movement of the tube in the longitudinal direction.

In FIG. 4, the cylinder 10 has the pin 11 removed from the hole 12. The slide 3 and the main slide 7 are now disconnected. The locking devices in this embodiment are the adapters.

FIGS. 5 and 6 show the locking devices 6 of the adapters. The locking devices have pneumatic cylinders 10 which moves pins 11 into holes 12 and also remove the pins 11 from the holes 12. In FIG. 5, the pin 11 is inserted into the hole 12. The slide 3 is now locked to the main slide 7. Each of the cylinders 19 has a valve V which is connected with the computer C controlling the function of the whole machine. The valves open and closed electrically, or in other words in an NC programmable manner.

Naturally, a separately movable slide rail 12 can be provided for each slide rail extension 20, 22, 23, 24. However, this would mean considerable additional expense for control, drive and measurement devices.

It will be understood that each of the elements described above, or two or more together, may also find a useful application in other types of constructions differing from the types described above.

While the invention has been illustrated and described as embodied in bracing device for a bending machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A bracing device for a bending machine, in particular for a tube bending machine, in the form of a slide rail (12), moved linearly in slaved fashion in the bending operation, with a plurality of slide rail extensions (20, 22, 23, 24) for different bending radii, wherein the slide rail extensions (20, 22, 23, 24) are mounted on the slide rail (12) via lockable and unlockable adapters (21), and wherein the locking and unlocking of the adapters (21) is programmable via an NC controller, and means (M) are provided for NC controller programmable locking and unlocking of the adapters (21).

2. The device of claim 1, wherein the slide rail extensions (20, 22, 23, 24) and the adaptor (21) form a retrofitting unit.

3. The device of claim 1, wherein the plurality of slide rail extensions (20, 22, 23, 24) and the adapter (21) are separately adjustable in height.

4. A bending machine, in particular a tube bending machine (10), having a clamping device (11) for a workpiece, in particular a tube to be bent, a bending head (17) provided with a plurality of bending tools (15) that have different radii, and a pivot arm (14) that has a plurality of clamping jaws (18) that can be moved horizontally and/or vertically to the longitudinal axis of the workpiece and that cooperate with the bending tools (15), wherein it has a bracing device of claim 1.

* * * * *